US005323571A

United States Patent [19]

Frari

[11] Patent Number: 5,323,571

[45] Date of Patent: Jun. 28, 1994

[54] GRINDING MACHINE FOR GRINDING TRIPODS OF CONSTANT VELOCITY COUPLINGS

[76] Inventor: Adolfo Frari, Via Torino 77, Bosconero (TO), Italy

[21] Appl. No.: 964,389

[22] Filed: Oct. 20, 1992

[30] Foreign Application Priority Data

Oct. 23, 1991 [IT] Italy ..... TO91A000792

[51] Int. Cl.[5] ..... B24B 49/00

[52] U.S. Cl. ..... 51/165.77; 51/165.71; 51/103 R; 51/105 R; 51/105 EC; 51/232

[58] Field of Search ..... 51/165.71, 165.76, 165.77, 51/103 R, 105 R, 105 EC, 230, 231, 232, 233, 234

[56] References Cited

U.S. PATENT DOCUMENTS 3,909,983 10/1975 Lasselle et al. ..... 51/105 EC 4,870,784 10/1989 Ramos et al. ..... 51/105 EC

*Primary Examiner*—Bruce M. Kisliuk

*Assistant Examiner*—Eileen Morgan

*Attorney, Agent, or Firm*—McGlew & Tuttle

[57] ABSTRACT

A grinding machine for grinding tripods of constant velocity couplings allows execution of circular or elliptical profiles on each tripod stem. A piece holder has means for supporting the tripod, which means allows bringing into a working position a new stem without need of removing the tripod from the holder. The precise execution of the elliptical profile is obtained by rocking the workhead, to which the piece holder is fastened, by means of a piezolectric transducer.

10 Claims, 4 Drawing Sheets

GRINDING MACHINE FOR GRINDING TRIPODS OF CONSTANT VELOCITY COUPLINGS

FIELD OF THE INVENTION

The present invention refers to machine-tools and more particularly it concerns a grinding machine for executing, on a plurality of elements of a workpiece, a circular profile or a profile the points of which are not all at the same distance from the element axis. Preferably but not exclusively, the grinding machine is intended for executing circular and/or elliptical profiles on the so called "tripods" of constant velocity couplings, and the description will refer in particular to that application.

BACKGROUND OF THE INVENTION

Tripods are elements comprising a central body with an axial bore engaged by a shaft; three appendages or stems radially project from the body at 120° with respect to each other, and rollers, sliding in guides provided in an element carried by a second shaft, roll over the surfaces of said stems. Independently of the actual stem shapes, the external stem surfaces comprise a cylindrical or spherical portion which is to be ground so as to have an elliptical or circular profile, depending on the kind of coupling. Moreover, in the case of an elliptical profile, the eccentricity may vary in accordance with the requirements of the coupling users. Very narrow tolerances are permitted for both profiles. It will be apparent that for maximum operation flexibility a grinding machine must be able to execute both kinds of profiles and to adapt itself to the different user requirements in case of elliptical profiles.

In commercially available machines of that kind the workhead allows the usual piece rotation and moreover it can be rocked to vary the piece distance from the grinding wheel during rotation when the elliptical profiles are to be executed.

In such known machines, the piece is worked while being held between the centers, with a conventional faceplate transmission system, or on a fixed piece holder. Whatever the profile to be executed, such machines have the drawback of very long working cycles, with considerable dead times in piece positioning, due to the nature of the piece supporting means. In effect, the three tripod stems must be individually worked and, after completion of the working of a stem, an external loader is to be brought into engagement with the piece, the means retaining the piece on the support are to be released, the piece is to be removed from the support, rotated by 120°, and located again accurately and fastened onto the support; after that the external loader is to be moved away. All these operations are made while the grinding machine is stopped.

Moreover, as far as the control of the workhead rocking is concerned, the conventional grinding machines use hydraulic systems or mechanical systems with cams operated by electrical or hydraulic motors. The former systems have the drawback that the viscosity of the fluid used varies with temperature, whereby the response time is not constant. The latter systems have the drawback that the translatory movements are slow. Moreover, observing working tolerances is rather difficult in both cases, especially in case of very narrow tolerances.

SUMMARY AND OBJECTS OF THE INVENTION

These drawbacks are obviated by the grinding machine according to the invention, in which the structure of the piece supporting means allows a dead time reduction in piece positioning, and the rocking control is fast and accurate and allows for consistency of the response time and the observance of the tolerances to be achieved.

The grinding machine according to the invention is characterized in that the means supporting and holding the piece and controlling the movements thereof comprise:

a body which is carried by an arbor imparting to the piece an indexing movement about an axis coinciding with the axis of the element being worked;

a member for receiving the piece to be ground, which member is located in a seat provided in said body, has a longitudinal axis perpendicular to the body rotation axis and is associated with means causing its axial displacement between a first position, the member takes during the execution of the profile on one piece element, and a second position to which the member is moved at the end of the profile execution on said element, with means causing the member rotation about its axis, while it is in said second position, to bring another piece element to a working position, and with means for preventing said rotation while the member is in its first position;

a piece holding member, arranged in an axial cavity of the receiving member and associated with elements for retaining the piece on the receiving member, said holding member being axially slidable in said cavity between a first position, it keeps as long as the piece is being worked and in which the retainig elements are in engagement with the piece itself, and a second position, it takes for allowing insertion thereon of a piece to be worked and removal therefrom of a worked piece and in which the retaining elements are out of engagement with the piece;

a resilient member, which is fastened to the workhead and to a stationary portion of the grinding machine which resilient member can bend according to an axis parallel with the axis of the element being worked and presents, perpendicularly to that axis, such a size as to prevent the contact between the workhead and the stationary portion in maximum bending condition, the bending axis lying in a gap separating the workhead from the stationary portion;

a piezoelectric transducer, mounted between the workhead and the stationary portion and having a lenght which is periodically varied to cause bending of the resilient member and rocking of the workhead to vary the distance of the element being worked from the axis.

BRIEF DESCRIPTION OF THE DRAWINGS

For a better understanding, reference is made to the accompanying drawing in which.

DETAILED DESCRIPTION OF THE PREFERRED EMBODIMENT

Figure 1:
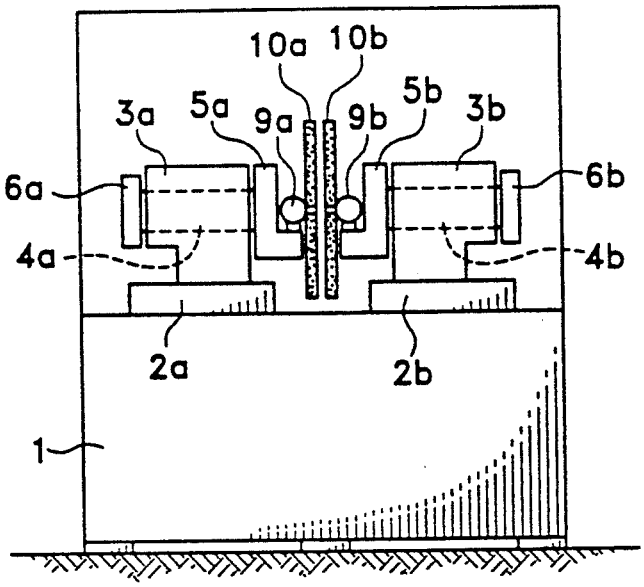
FIG. 1 is a schematic representation of a grinding machine according to the invention.
Figure 2:
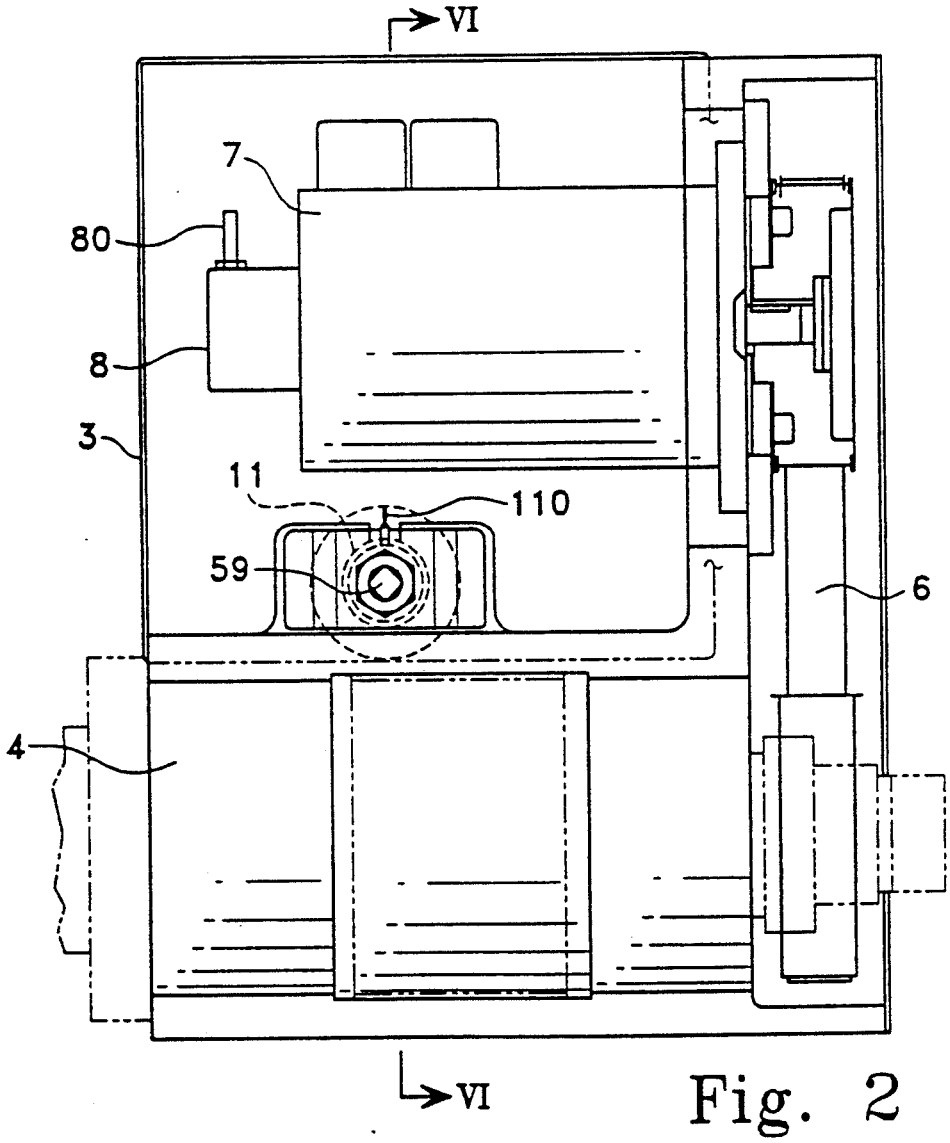
FIG. 2 is a plan view of part of a workhead.

Referring to FIGS. 1 and 2, the grinding machine according to the invention allows simultaneous working of two pieces and comprises a base 1 onto which two worktables 2*a*, 2*b* are mounted, each worktables bearing a respective workhead 3*a*, 3*b*. A respective precision arbor 4*a*, 4*b* is rotatably mounted in each workhead and is integral during rotation with a respective piece holder 5*a*, 5*b*. The arbors are driven, e.g. through a belt transmission 6*a*, 6*b*, by respective electrical motors 7, e.g. of the brushless type, associated each with a respective encoder 8, in particular for the execution of the elliptical profile. Encoder 8 generates position signals on line 80, connected to a conventional numerical control (not shown) of the machine, allowing control of the angular position of the holder. References 9*a*, 9*b* denote the workpiece (more particularly, tripods of constant velocity couplings) and references 10*a*, 10*b* denote the grinding wheels, carried in a conventional manner by a wheel carrying slide (not shown).

Motors 7 cause tripod rotation about the axis of the steam being worked. The tripods are mounted on the holder so as to be rotated by 120° about the axis of the central body, after grinding of a stem, to present the subsequent stem to grinding wheel 11. Workheads 3 are mounted on the respective tables so as to rock about a longitudinal axis parallel with the respective arbor axis, when the tripod stems are to be ground according to an elliptical profile. Rocking is controlled by a piezoelectric transducer 11 which may extend and retract because of the application of controlled electric voltages fed through line 110 upon command of the numerical control.

The transducer is controlled by the numerical control as any other machine axis.

Figure 3:
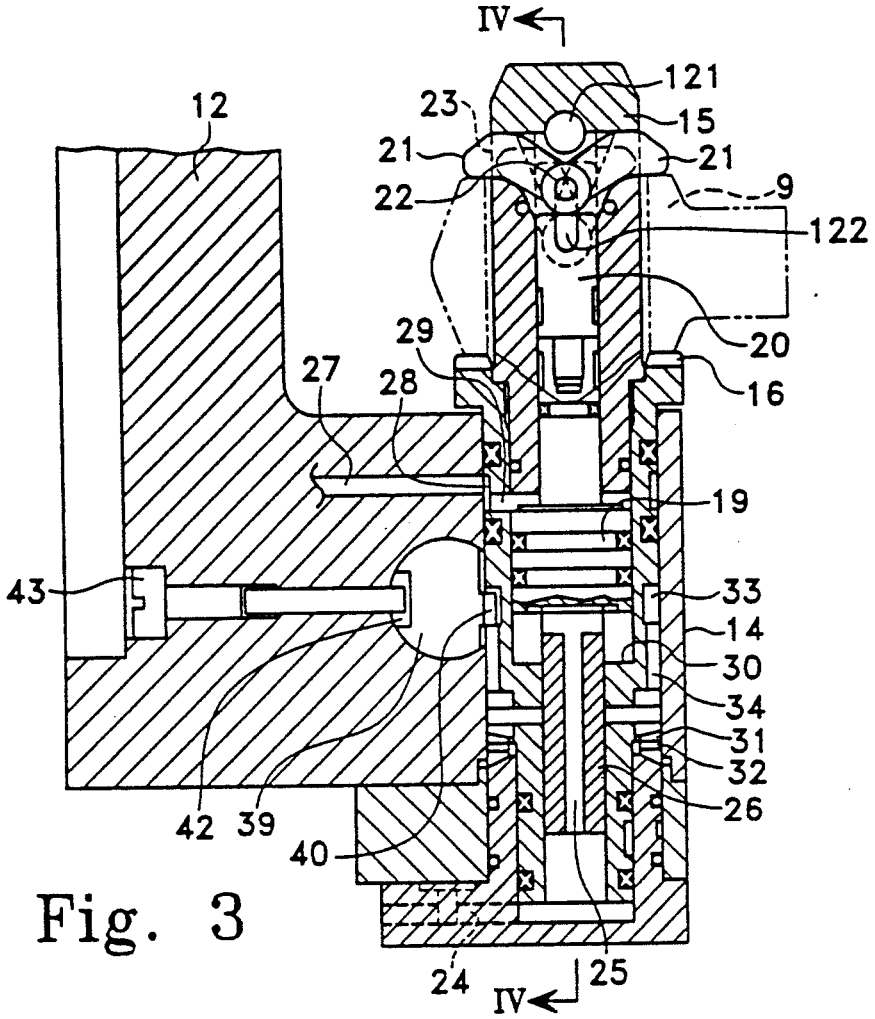
FIG. 3 is a sectional view of the piece holder.
Figure 4:
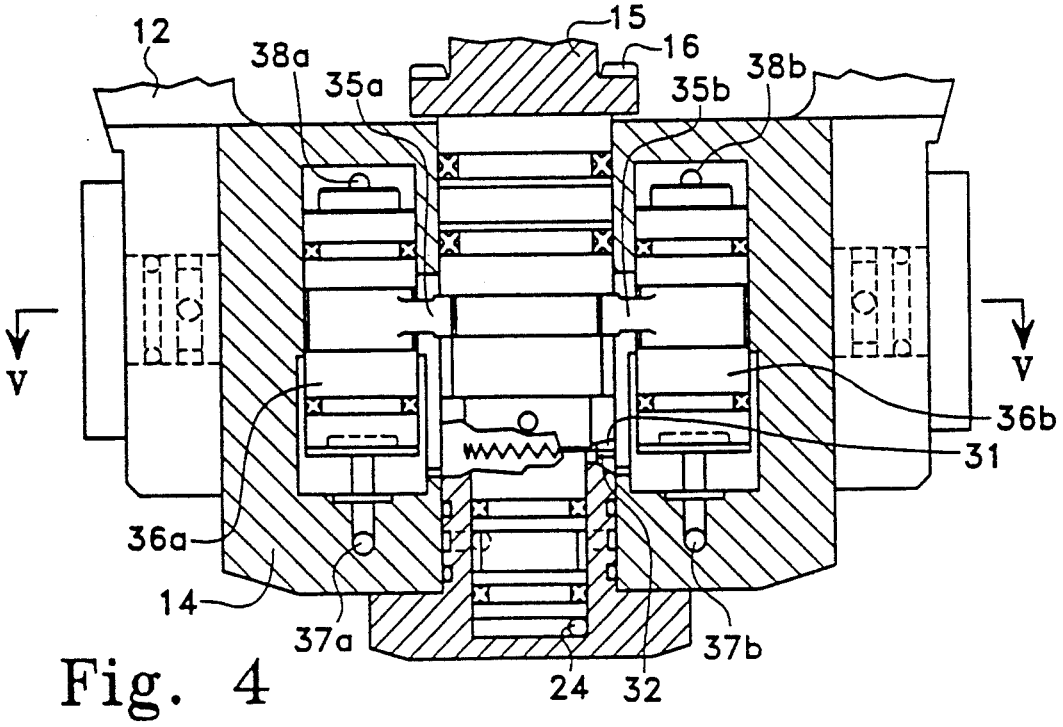
FIG. 4 is a cross sectional view taken along line IV—IV in FIG. 3.
Figure 5:
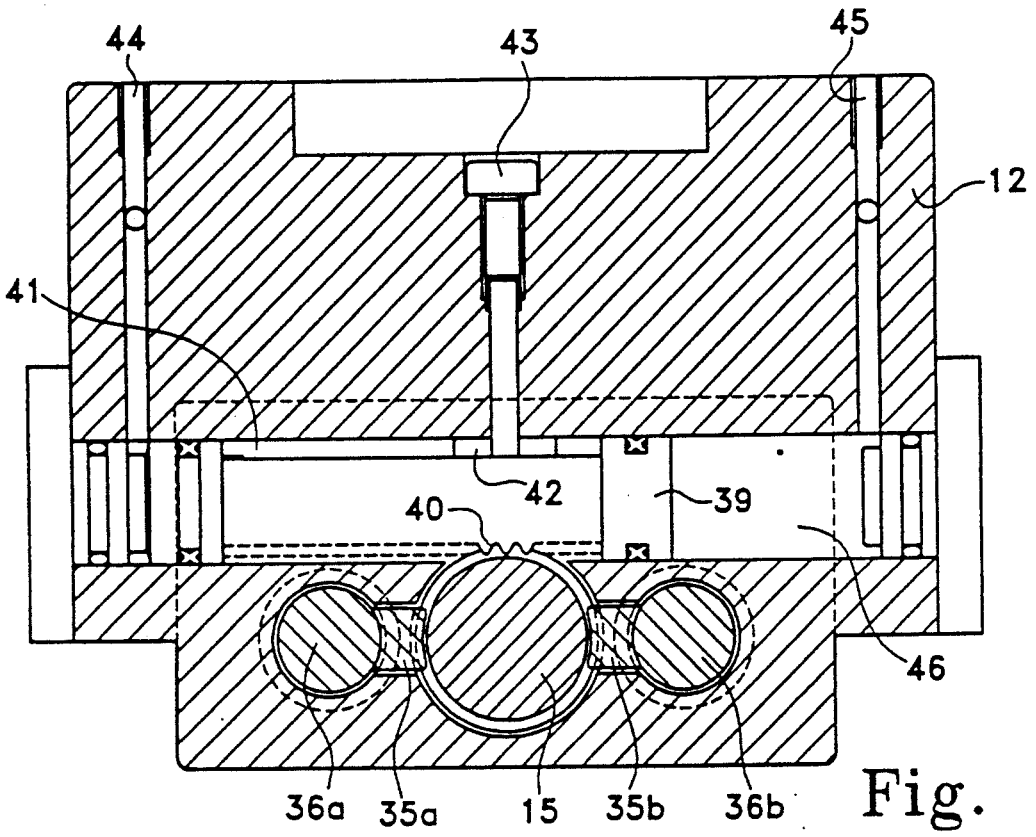
FIG. 5 is a cross sectional view taken along line V—V in FIG. 4.

FIGS. 3 to 5 show that a piece holder 5 comprises a substantially L-shaped body 12, the vertical portion of which is fastened to arbor 4 in any known manner. The horizontal portion of the L-shaped body bears a housing 14 for the lower portion of a column 15 onto which a tripod 9 to be ground is located so as to rest against an abutment 16.

Column 15 has an axial cavity where a piston 19 slides. The upper portion of piston 19 is integral with a rod 20 onto which there are pivotally mounted two arms 21 retaining and blocking tripod 9 onto abutment 16 during working of a stem.

Arms 21 are hinged onto a pivot pin 22 which is carried by rod 20 and the ends of which slide in slots 122 provided in the surface of column 15.

In the raised position of piston 19, arms 21 diverge and jut out from openings 23 in the column so as to abut against the upper surface of the body of tripod 9. In the lowered piston position, said arms are retracted within the column, thereby allowing insertion of a piece to be worked or removal of a worked piece. Upwards sliding of piston 19 brings the arms against a stop 121 which causes them to diverge and to jut out from openings 23. A duct 24 in housing 14 and a duct 25 in a rod 26 integral with the lower face of piston 19 bring against said face pressure fluid intended to cause upwards sliding of the piston. A duct 27, ending in an annular groove 28 provided in the external surface of column 15 and communicating with the inside of the column through a duct 29, brings fluid against the upper face of piston 19 to cause downwards movement of the piston. The downwards stroke of piston 19 is limited by a step 30 in the internal surface of column 15.

Column 15 may be raised from the illustrated position and rotated by 120° about its axis to present another tripod stem to the grinding wheel. In the lowered position, which is kept while a tripod stem is being ground, column rotation within housing 14 is prevented by the engagement between two axial toothings 31, 32 provided on a step joining a central column portion with a lower portion of reduced diameter and on a housing recess, respectively.

To allow column raising and rotation, the column outer surface is provided in its central portion with an anular groove 33 and with a toothing 34 immediately below said groove. Groove 33 is engaged by appendages 35*a*, 35*b* of vertically slidable pistons 36*a*, 36*b*, respectively. Vertical sliding of the pistons causes vertical sliding of the column. The pistons are simultaneously operated and are also carried by body 12 of the piece holder. The fluid for operation of pistons 36*a*, 36*b* is brought by ducts 37*a*, 37*b* for the piston raising, and by ducts 38*a*, 38*b* for the lowering.

A further piston 39 with horizontal axis perpendicular to the arbor axis, is mounted at the end of the horizontal portion of body 12, between such body and column 15. Pistons 39 is provided, along two substantially diametrically opposite generatrices, with a rack 40 (facing column 15) and respectively a groove 41 (facing body 12). In the lowermost column position, the rack teeth are located within groove 33, whereas, upon raising of column 15, the rack engages toothing 34, so that operation of piston 39 causes the column rotation necessary to bring another tripod stem to the working position.

A tongue 42 housed in groove 41 of piston 39 engages the end of a screw 43 which longitudinally extends through the horizontal portion of body 12. The relative cross-sectional sizes of groove 41 and tongue 42, are such as to allow a frictionless sliding of piston 39 while preventing any rotation of same while column 15 is sliding. Ducts 44, 45 bring the fluid necessary for causing piston 39 to slide in either direction within a chamber 46. It will be appreciated that, since rack 40 does not mesh with toothing 34 when the column is in its lowermost position, piston 39 may be moved back to its starting position while working of a new stem is already in progress. This contributes to dead time reduction.

The usual sealing gaskets between relatively moving members, the feeding discharging ducts for the fluid and the means for fastening the different mechanical elements together are not described in detail since they are wholly conventional and have no importance for the understanding of the invention.

Figure 6:
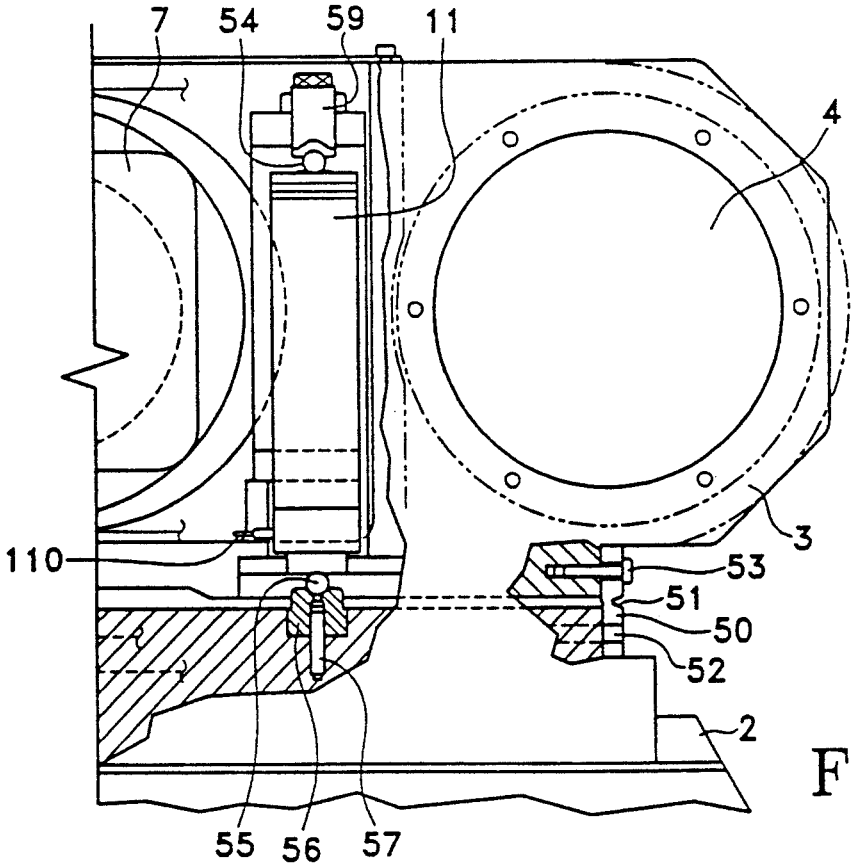
FIG. 6 is a cross sectional view taken along line VI—VI in FIG. 2.
Figure 7:
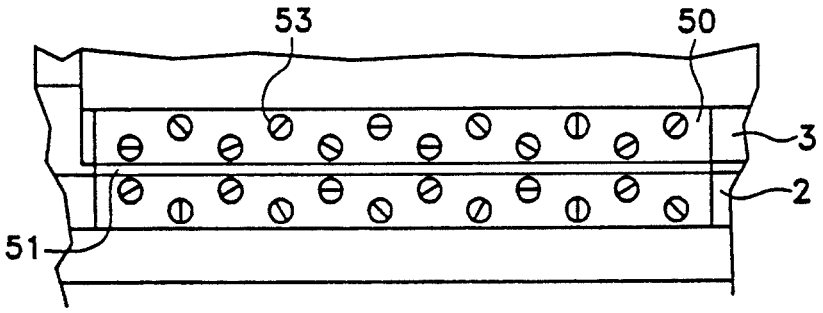
FIG. 7 is a front view of a detail of FIG. 6.

Referring now to FIGS. 6, 7, worktable 2 and workhead 3 are connected by a leaf spring 50, parallel with the spindle axis. The spring leaf can bend about a horizontal axis parallel with axis of arbor 4 upon length variations of transducer 11. In rest conditions of the spring, such axis lies in a same vertical plane with the axes of arbor 4 and of the tripod stem being worked. The spring flexibility is provided by a longitudinal groove 51 in the spring itself. Bores 52 allow the spring to be fastened by means of screws 53 within a seat defined by two facing recesses in worktable 2 and workhead 3. The vertical size of the spring 50 is such as to prevent any contact between the workhead and the worktable during workhead rocking. The fastening allows by means of screws an easy spring substitution and hence use of the most suitable spring for any given working.

The upper and lower end faces of transducer 11 (or the faces of members fastened to said end faces) are provided with seats for upper and lower balls 54, 55, respectively. Lower ball 55 also engages a seat in the upper face of an insert 56 fastened by means of a screw 57 to worktable 2. Upper ball 55 engages a seat provided in the lower end of an adjustment screw 59 mounted in workhead 3 so as to be accessible from outside. Engagement between balls 54, 55 and the respective seats on the transducer and the worktable is the only mechanical link between transducer 11 and the members of the grinding machine. Adjustment screws 59 of both workheads allow the positions of transducers 11 to be adjusted so that the two workheads rock perfectly in phase (what is required because the grinding wheels are rigidly connected), and ensure at any moment the coplanarity between the axis of the stem being worked and the bending axis of the leaf spring. Thus, the unavoidable differences in construction and mounting of the workheads and worktables are compensated.

Figure 8:
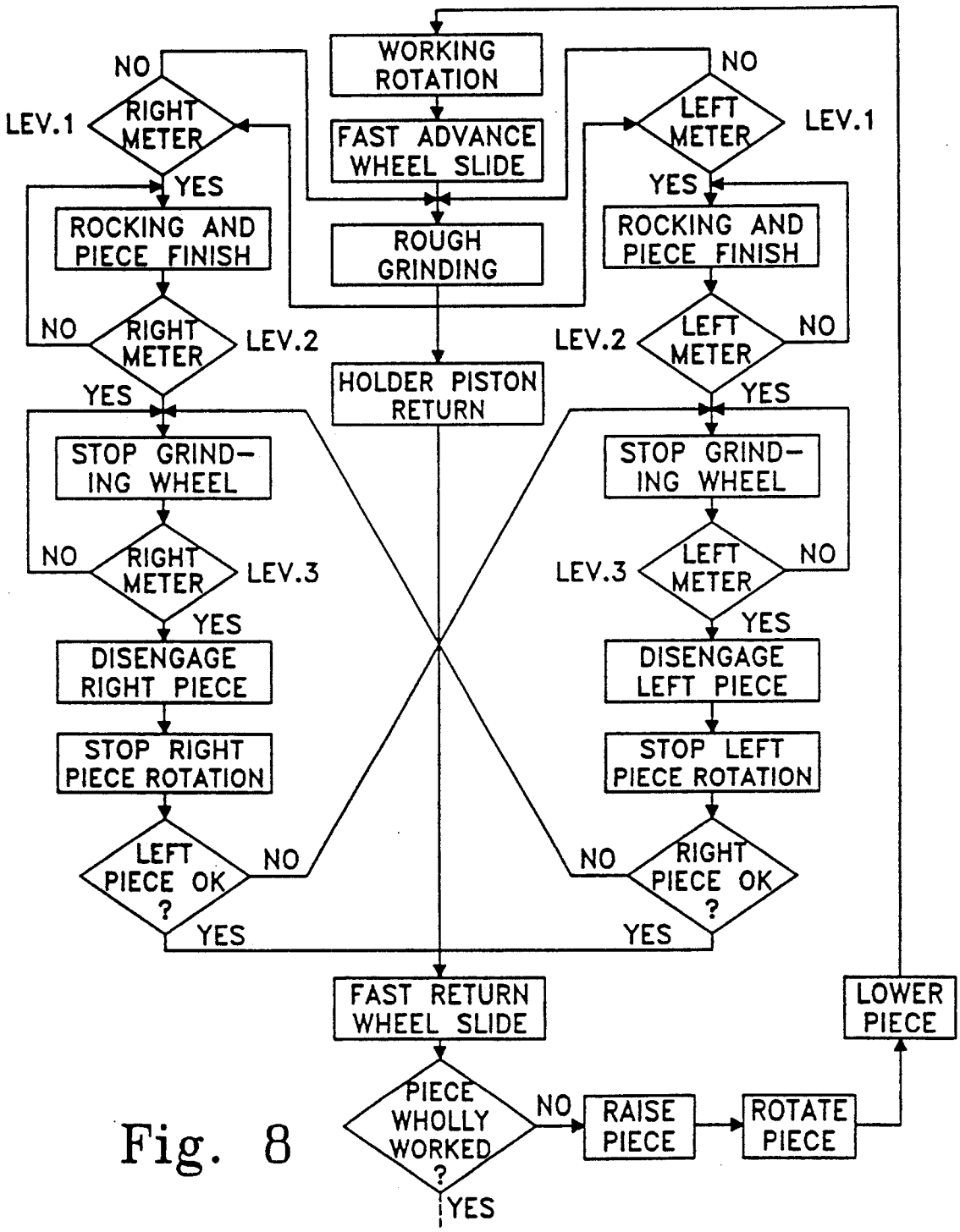
FIG. 8 is a flow chart of the operation of the machine.

The operation of the grinding machine will now be described, with reference also to FIG. 8, for the execution of an elliptical profile.

The two tripods 9 to be ground are brought in correspondence with columns 15 of the respective piece holders and inserted onto the columns by means of external loaders. The tripods are previously arranged on the loaders so that the first stem is in proper position with respect to the grinding wheels. During loading, pistons 19 are in the lowermost position and arms 23 are retracted within the respective column.

Once the tripods have been inserted onto the respective column 15, pistons 19 are operated so that arms 23 come out of the column to retain the pieces on abutments 16, arbor rotation is started and the grinding wheels are brought to the working position by a fast displacement of the slides. In a first step, a rough grinding is effected to reduce the stem diameter to a first predetermined value. The rough grinding is effected by moving forward the grinding wheels at constant speed. Obviously the grinding wheels are moved forward in steps, each step corresponding to a complete revolution of arbors 4 and hence of holders 5 and of the stem being worked. During working, the engagement between axial, toothings 31, 32 ensures that no unwanted movements of the tripods take place.

The attainment of the first diameter value, which can take place at different time instants for the two pieces, is detected by known means.

The subsequent operations are independently effected for the two pieces, even if in an identical manner; hence working of only one piece, for instance the right one, will be described.

Once the first value has been attained (Right meter=Yes, Lev. 1), the second step (Rocking and piece finish) begins. During such a second step transducer 11 is operated so as to cause workhead rocking resulting in the piece surface periodically moving closer to or farther from the grinding wheel. During that step the grinding wheel are moved forward at progressively decreasing speed. The workhead rocking is to be suitably synchronized with the piece rotation so as to obtain a perfectly symmetrical profile on the four quadrants. Generally, rocking begins after a tripod has been rotated by a predetermined angle with respect to a starting position, brings the piece to a minimum distance from the grinding wheel when the angle is 90° and then brings back the piece to the initial distance in correspondence with a point of the second quadrant symmetrical with respect to the rocking starting point in the first quadrant. The cycle is then repeated for the third and fourth quadrants.

The synchronization is obtained by means of encoder 8 which sends the position signals to the numerical control so that the latter can start and stop rocking at the desired positions and supply transducer 11 during rocking with such voltages causing the length variations required to obtain the profile.

The second step ends when an axis of the piece, already made elliptical, attains a second predetermined value (Right meter=Yes, Lev. 2). At that moment the forward movement of the grinding wheel is stopped (stop grinding wheel). Arbor rotation and oscillation on the contrary go on until the final size has been attained (Right meter=Yes, Lev. 3). Now the grinding wheel is brought out of contact from the piece (Disengage piece), the piece rotation is stopped, the end of the working of the other piece is waited for, and the grinding wheels are brought back to the idle position. Then, while pieces 9 are still retained and blocked on, respective columns 15, the latter are raised by cylinders 35 and rotated by 120° through racks 40 so as to prepare the second stem of each tripod for working. After the rotation, the columns are again lowered so that teeth 31, 32 mesh again, and the second stem is ground in the manner described. During such operations, piston 39 with rack 40 is brought back to idle conditions. The same operation sequence is repeated for the third stem.

Obviously, if a circular profile is to be executed, steps 2 and 3 are performed without rocking the workheads.

The above description clearly shows that the dead times are extremely reduced in comparison to conventional machines, as removing a piece from holder 5 and locating it again on the holder at the end of the working of each stem is no longer required. Moreover, thanks to the use of a piezoelectric transducer for controlling workhead rocking, the problems inherent in use of hydraulic or mechanical devices for the same aim are eliminated. Further, starting workhead rocking through an encoder connected to the numerical control of the machine allows an easy adaptation to the requirements of the different coupling users.

What I claim is:

1. A grinding machine for executing, on each of a plurality of elements of a workpiece, a circular profile or a profile having points which are not at the same distance from an element axis, the machine comprising:

a workhead with supporting and holding means for supporting and holding a workpiece during working and for moving the workpiece for execution of a desired profile including rotating the workpiece about an axis of the element being worked for obtaining a circular profile and rocking the piece to periodically vary a distance of said element from said grinding wheel for obtaining a profile with points which are not at a same distance from the axis of the element being worked, a grinding wheel, said support and holding means including an arbor, a body carried by said arbor for imparting rotational movement to the workpiece about an axis coinciding with the axis of the element being worked, said body including a seat, a receiving member for receiving the workpiece, said receiving member being positioned in said seat of said body and including a longitudinal axis perpendicular to a rotation axis of said body, said receiving member being axially displaceable between a first position said receiving member assumes during execution of a profile on one workpiece element of the workpiece and a second position in to which said receiving member is moved at an end of profile execution on said element, receiving member actuation means for displacing said receiving member between said first position and said second position, rotation means for rotating said receiving member about an axis of said receiving member while said receiving member is in said second position to bring another element of the workpiece to a working position, stop means for preventing rotation of said receiving member in said first position, a workpiece holding member, positioned in an axial cavity of said receiving member and cooperating with retaining elements for retaining the workpiece on said receiving member, said workpiece holding member being axially slidable in said cavity between a first position for working on the workpiece, wherein the retaining elements are in engagement with the workpiece, and a second position for allowing insertion of the workpiece and removal of the workpiece, wherein the retaining elements are out of engagements with the workpiece, a resilient member fastened to said workhead and fastened to a stationary portion of said grinding machine, said resilient member being bendable with respect to a bending axis parallel to the axis of the element being worked on, said resilient member having a size in the direction perpendicular to the axis of the element being worked on so as to prevent contact between said workhead and said stationary portion of said grinding machine in a maximum bending condition, said bending axis lying in a gap separating said workhead from said stationary portion of said grinding machine, and a piezoelectric transducer, mounted between said workhead and said stationary portion of said grinding machine and having a length which is periodically varied to cause bending of said resilient member and rocking of said workhead to vary a distance of the element being worked from said bending axis.

2. A grinding machine according to claim 1, wherein said workpiece is a tripod of constant velocity couplings, and the elements to be profiled are portions of the external surfaces of radial appendages of the tripod, said elements being ground according to a same circular or elliptical profile.

3. A grinding machine according to claim 1 or 2, wherein said axial displacement means comprises a pair of pistons which are each integral with an appendage engaging an annular groove of a housing, the two pistons being simultaneously operated.

4. A grinding machine according to claim 3, wherein said rotation means comprises a rack that, when said receiving member is in said second position, engages radial teeth on said housing and, when the member is in its first position, is located in said annular groove, in a portion which is not occupied by said appendages.

5. A grinding machine according to claim 4, wherein said rack is formed integral with a piston which is operated to make, the rack slide and rotate the receiving member when the latter has attained its second position, and is operated to bring back the rack to an idle position after the holding member has resumed its first position.

6. A grinding machine according to claim 1 or 2, wherein said stop means comprises axial teeth on said receiving member which mesh with complementary axial teeth on said seat.

7. A grinding machine according to claim 1 or 2, wherein said holding member comprises a piston and a rod, said piston being integral with said rod, said rod having a free end to which a pair of arms are pivotally connected, said arms forming said retaining elements whereby in the first position of the holding member, said arms diverge and jut out from said cavity of said receiving member to engage an upper portion of the workpiece and to keep it against an abutment on the receiving member, whereas in the second position of the holding member said arms are retracted within said cavity of said receiving member.

8. A grinding machine according to claim 7, wherein said receiving member is provided with means for engaging said arms during axial sliding movement of the holding member to cause said arms to diverge and jut out through openings in the walls of the receiving member.

9. A grinding machine according to claim 1 or 2, wherein said resilient member is a leaf spring with a longitudinal groove in correspondence with the bending axis, said leaf spring is removably fastened to the workhead and the stationary portion.

10. A grinding machine according to claim 1 or 2, wherein said piezoelectric element is mounted through ball joints between said workhead and the stationary portion and is associated with means for adjusting its position.

* * * * *